US006119292A

United States Patent [19]

Haas

[11] Patent Number: 6,119,292

[45] Date of Patent: Sep. 19, 2000

[54] PATIENT TORSO SUPPORT AND TURNING SYSTEM

[75] Inventor: Tommy B. Haas, Riverton, Utah

[73] Assignee: Air Med Assist Products, LLC, Salt Lake City, Utah

[21] Appl. No.: 09/206,743

[22] Filed: Dec. 7, 1998

Related U.S. Application Data

[63] Continuation-in-part of application No. 08/891,743, Jul. 14, 1997, abandoned.

[51] Int. Cl.[7] ..... A61G 7/057; A47C 27/10

[52] U.S. Cl. ..... 5/715; 5/713

[58] Field of Search ..... 5/715, 713, 710, 5/714, 615

[56] References Cited

U.S. PATENT DOCUMENTS

| | | | |
|---|---|---|---|
| 1,772,310 | 8/1930 | Hart | 5/713 |
| 2,998,817 | 9/1961 | Armstrong | 5/713 |
| 3,390,674 | 7/1968 | Jones | 5/713 |
| 4,934,002 | 6/1990 | Watanabe | 5/615 |
| 4,953,247 | 9/1990 | Hasty | 5/713 |
| 5,092,007 | 3/1992 | Hasty | 5/715 |
| 5,121,512 | 6/1992 | Kaufmann | 5/715 |
| 5,142,720 | 9/1992 | Kelso et al. | 5/715 |

*Primary Examiner*—Alexander Grosz
*Attorney, Agent, or Firm*—Marcus G. Theodore

[57] ABSTRACT

A portable patient torso support and rotating system mattress overlay having a base sheet sized to fit under a patient with means to secure it to the support surface of a mattress, and two side by side pairs of inflatable and deflatable bladders attached to the base sheet and sized and positioned to fit under each side of the torso of a patient lying thereon and structured, when fully inflated, to rotate the patient up to 90 degrees to turn on their hip.

16 Claims, 7 Drawing Sheets

PATIENT TORSO SUPPORT AND TURNING SYSTEM

RELATED APPLICATIONS

This application is a continuation-in-part application of the originally filed application entitled "Patient Torso Support and Turning System", Ser. No. 08/891,743 filed Jul. 14, 1997, now abandoned.

BACKGROUND OF THE INVENTION

1. Field

This invention pertains to body supporting apparatuses. More particularly, it relates to a portable, patient torso support and turning system mattress overlay for bed confined patients, which also prevents bedsores, promotes circulation, and addresses other clinical therapies. It provides a torso support and rotation system with leg lift capability.

2. State of the Art

Various body supporting apparatuses for confined patients are known. Jones, U.S. Pat. No. 4,977,629 discloses a portable inflatable patient assist apparatus comprising a multi-chambered, normally deflated pad positioned on a bed underneath a bedridden patient which is selectively inflated to rotate the patient from side to side or raise a patient sufficient for the insertion of a bed pan underneath the patient. Jones' single bladder partially rotates a patient on their side, but the single layer bladder system is incapable of fully rotating the patient 90 degrees or of securing said patient in position. Hasty, U.S. Pat. No. 5,103,519 is another single layer inflatable patient assist apparatus, which is selectively inflated to rotate a patient from side to side, but is incapable of fully rotating a patient 90 degrees. Kelso et al, U.S. Pat. No. 5,142,720 is an inflatable patient positioning device located under the hips to assist in moving a patient. However, it does not extend along the torso to prevent twisting of the spine during inflation.

Hasty, U.S. Pat. No. 5,092,007 is a single piece multi-chambered air mattress overlay including a pair of parallel main rolling chambers arranged under the majority of the length of a patient's body. During inflation, this mattress design bulges upward and laterally to assist in rolling the full body of a patient. This full body positioning system can create back and hip problems for certain patients with hip and joint problems. It also must be deflated to elevate the bed to raise the upper body of the patient. If Hasty is not deflated, the patient slides along the fill body bladders when raised causing sheer aggravating bed sores.

This full body bladder multi-chamber construction bulges and lifts during inflation and is difficult to maintain securely in position against the underlying mattress, when inflated. It therefore has dead spots where a patient can bottom out against the mattress creating bed sores. Barnett et al. U.S. Pat. No. 5,010,608 discloses a monolayer mattress of parallel bladders, which oscillate to prevent bedsores.

Parker, U.S. Pat. No. 3,394,415 discloses a dual layer mattress with parallel longitudinal bladders which sequentially inflate and deflate to oscillate on a support mattress to prevent bedsores. Peck et al, U.S. Pat. No. 4,803,744 discloses a multi-layer inflatable bladder system. Schild et al., U.S. Pat. No. 4,391,009 discloses another multi-layer ventilated body support mattress.

Schild, U.S. Pat. No. 5,109,561 discloses a monolayer mattress with parallel bi-polar cell bladders, with each cell having a height greater than its width, and an internal membrane arranged to restrict the shape of the cell and divide it into two communicating regions. Teasdale, U.S. Pat. No. 5,243,721 discloses a mattress with parallel latitudinal bladders connected in series such that the bladders are sequentially inflated and deflated to oscillate. Tappel, U.S. Pat. No. 5,542,136 discloses another mattress with parallel latitudinal bladders connected in series such that the bladders are sequential inflated and deflated to oscillate. Other pneumatic mattresses with parallel latitudinal bladders are: Welch, U.S. Pat. No. 4,193,149, Johnson et al., U.S. Pat. No. 5,373,595; Tappel et al, U.S. Pat. No. 5,325,551; Volk, U.S. Pat. No. 5,267,364; Vrzalik, U.S. Pat. No. 5,044,029; Guthrie et al., U.S. Pat. No. 5, 235,713; Swart, U.S. Pat. No. 4,686,722; Cadan et al, U.S. Pat. No. 5,090,077; Dotson, U.S. Pat. No. 5,020,176; Wridge, Jr., et al., U.S. Pat. No. 4,995,124; and Goode, U.S. Pat. No. 4,949,412;

Bodine, Jr. et al., U.S. Pat. No. 5,375,273 discloses a mattress with parallel longitudinal bladders connected in series such that the bladders are sequentially inflated for patient's lateral rotation therapy. Bodine, Jr. et al rotates a patient up to approximately 45 degrees on each side, and has inflatable ends extending beyond the torso which balloon to twist a patient's legs at an angle different than the spine during the inflating sequence. Brady, U.S. Pat. No. 4,872,229 discloses another mattress with parallel longitudinal bladders with a vibrator cushion portion. Other parallel longitudinal bladder mattresses are Kaufinann, U.S. Pat. No. 5,121,512, Swensen et al, U.S. Pat. No. 4,394,784; and Lovitt, U.S. Pat. No. 5,115,525.

Walter, U.S. Pat. No. 5,267,365 discloses a mattress with a plurality of cells in a checkerboard fashion which are sequentially inflated to provide variable point-like contact spots to minimize mattress body contact. Schulman, U.S. Pat. No. 4,852,195 discloses a cushion with a plurality of octagonal cells in a matrix which are selectively inflated and deflated to sequentially shift body support from one set of cells to another for promoting blood circulation and enhancing comfort. Evans, U.S. Pat. No. 4,864,671 discloses an inflatable cushion that includes a number of independently inflatable rows or zones of cells connected to a pressure port of a three-way valve and the intake ports of a pump which selectively inflates the cells to vary body contact. Other cell mattress systems are: Higgins, U.S. Pat. No. 4,982,466; Cvetkovic, U.S. Pat. No. 4,827,546; Kadish, U.S. Pat. No. 4,799,276; Douglas, U.S. Pat. No. 4,722,105; Douglas, U.S. Pat. No. 4,279,044; Torbet, U.S. Pat. No. 4,662,012; Johnson Sr., U.S. Pat. No. 4,737,998; Kawasaki, U.S. Pat. No. 4,986,738.

Other inflatable cushions with variable support are Graebe, Jr., U.S. Pat. No. 4,833,457; Smith et al., U.S. Pat. No. 5,029,939; DeLopper, U.S. Pat. No. 4,777,679; and Sexton, U.S. Pat. No. 5,068,933.

To regulate the inflation rate and mattress firmness, a number of valves and pumps have been developed: Sato, U.S. Pat. No. 4,542,547 discloses sensing means to adjust mattress inflation; Sato, U.S. Pat. No. 4,014,378 discloses a pneumatic mat with safety apparatus; Higgs, U.S. Pat. No. 5,249,319 discloses a variable speed blower and motor to selectively control the inflation rate; Chafee, U.S. Pat. No. 4,977,633 discloses a one way valve associated with a pump motor; Packard et al., U.S. Pat. No. 4,680,790 discloses a bedside control module to manually control various electrical devices; Savenije, U.S. Pat. No. 4,873,737 discloses a height measuring and control device for fluid filled mattresses; Kranzle, U.S. Pat. No. 4,810,169 discloses a pump unit; Cerrato et al, U.S. Pat. No. 4,171,004 discloses a safety regulator for excess fluid pressure; Paul et al, U.S. Pat. No.

4,694,520 discloses a detector to increase inflation of a mattress support when the mattress support is below a pre-set point; Ford et al, U.S. Pat. No. 4,711,275 discloses an air supply and control apparatus for inflatable mattresses; Hung, U.S. Pat. No. 4,715,787 discloses a coaxial, two-cylindered air compressor; Goode, U.S. Pat. No. 4,797,962 discloses a closed loop feedback air supply for air support beds; Gorran, U.S. Pat. No. 4,135,500 discloses an apparatus for oscillating flotation support systems; Harleroad et al., U.S. Pat. No. 4,993,920 discloses an air mattress pumping and venting system; Krouskiop, U.S. Pat. No. 4,989,283 discloses an inflation control for air supports; and Iijima et al, U.S. Pat. No. 4,715,790 discloses a compressor having pulsating reducing mechanism.

Cited for general interest are Steuer, U.S. Pat. No. 4,133,305 discloses a pneumatic mattress with vibration means to vary the preselected frequency within a range containing the breathing rates. Kawasaki et al, U.S. Pat. No. 4,986,738 discloses an airflow control system pump and housing for an interconnected cell mattress system to selectively inflate and deflate the cells. O'Kane, U.S. Pat. No. 1,576,211 discloses an air mattress with a separate peripheral higher-pressure segment than the center portion. Goodale, U.S. Pat. No. 4,757,564 discloses a mattress having a cover with a memory fabric. Wegener et al, U.S. Pat. No. 4,627,426 discloses a tear-away sterile and absorbent sheet for operating table use. Vessey, U.S. Pat. No. 4,189,798 discloses a foam mattress with flotation torso support. Steuer, U.S. Pat. No. 4,133,305 discloses a relaxation apparatus including a mattress and pneumatic vibrating device.

None of the above mentioned devices provides a rapidly inflatable and deflatable bladder patient torso support and rotating system to allow a care giver to rotate bedridden patients up to 90 degrees on their sides to change sheets, diapers, etc. Further, these devices do not cradle the patient to relieve pressure as the patient is held in varying positions. Nor do they provide adequate heel support for a patient to prevent bedsores as this product has the capability of doing. The invention described below provides such an apparatus.

SUMMARY OF THE INVENTION

The invention comprises a patient torso support and rotating system mattress overlay attached to the support surface of a mattress to turn a patient up to 90 degrees on their hip. It comprises a base sheet sized to fit under a patient with means to secure it to the support surface of a mattress. This base sheet is preferably made of a material which acts as a moisture barrier, such as nylon backed urethane, to protect the underlying mattress from body fluids. It is also sized to cover the top of the mattress support surface to properly position inflatable and deflatable stacked butterfly pillow bladders attached thereto underneath the torso of the bedridden patient to facilitate horizontal rotation of a patient.

Two side by side stacks of at least two "butterfly" pillow inflatable and deflatable bladders are longitudinally secured to the midline of the base sheet via their inner edges to form wing-like bladder pairs positioned under each side of the torso of a patient lying thereon. Since the butterfly bladders do not extend beyond the buttocks, they do not have to be deflated when the bed is raised to elevate a patient's head and torso.

The preferred embodiment has dual butterfly pillows stacked on top of one another under each side of the patient. They are connected to the mid-line of the base sheet and are then selectively inflated to lift one side of a patient to pivot on his hip. The first butterfly stacked pillow when fully inflated rotates the patient up to 45 degrees on his hip. The second butterfly stacked pillow is then fully inflated to completely rotate the patient up to 90 degrees on his hip. The paired stacked butterfly bladders are thus structured, when fully inflated, to balloon under either side of a patient to rotate the patient up to 90 degrees to turn on their hip. Thus to turn a patient, one butterfly bladder pair is inflated 90 degrees to turn and rotate the patient on his hip, allowing a single attendant to change the patient's pads and bed sheets, and bathe the patient.

For rotational therapy, the bladder sets are alternatively inflated and deflated to change the mattress surface contact points to minimize bed sore exposure, assist in breathing, and promote body circulation. Generally, these bladders are partially inflated to turn a patient up to approximately 30 degrees for rotational therapy. To immobilize a patient at a required angle, both bladder pairs are inflated to the desired firmness to secure the patient in position therebetween. For example, certain types of hip surgery require the patient to be held on their side. In this case, both bladders would be inflated to approximately 45 degrees to secure the patient in position therebetween to lie on their side and hip. The cradling of the patient in between the two butterfly bladder pairs act to side support and alleviate some of the pressure on the patient's hip. Thus cradled, it is also then possible to inflate one bladder pair and simultaneously deflate the other bladder pair a similar amount to securely hold the patient at varying angles to alleviate bed sores and provide for patient comfort.

The butterfly pillows are made of fabric similar to that of the base sheet. The stacks of the butterfly pillows are comprised of at least two stacked wing-like butterfly bladders having an ellipse shape. When inflated, one above the other, these butterfly pillows gently lift and support one side of the torso of a patient to gently rotate the patient. These butterfly bladder pillows are seamed/separated about the centerline (midline) of the base sheet by their inner parallel edges secured thereto. The butterfly bladders are then selectively inflated and deflated to the desired turgidity to turn a patient or secure the patient in a desired position. The preferred configuration is the wing-like configuration wherein each butterfly bladder pair is positioned under each half of the patient's torso. These butterfly bladders pairs are then selectively inflated to assist in moving the patient or provide for his needs.

The butterfly bladders include deflation valves to immediately deflate all bladders in the event of a CPR emergency, where it is necessary for the patient to be prone for cardiovascular treatment. The deflation valves include a pull attached thereto, which can be yanked in an emergency to immediately empty the butterfly bladders.

Inflation means, such as a blower and motor, are associated with the inflatable and deflatable bladder pairs to selectively simultaneously inflate one butterfly bladder pair while deflating the other butterfly bladder pair with fluids, such as air or water. The inflation means should be able to inflate and gently turn a patient in approximately 30 seconds or less. Generally, it takes approximately 20 seconds to rotate a patient on their side. This rapid speed of adjustment saves a caregiver's time, and provides infinite angles of patent repose to provide for a patient's comfort.

The preferred blower and motor provides rapid air inflation of all bladders. This is accomplished with high flow, low pressure (approximately 2 psig), blower system, which comprises a unique venturi system. This venturi system virtually sucks the air from certain bladders at the same rates it fills others.

An example of a preferred blower is the Minijammer™ one stage brushless DC blower produced by Ametek Technical Motor Division, 627 Lake Street, Ken Ohio. This 12 or 24 volt DC brushless blower has a standard-flow fan system that can be used for either vacuum or pressure airflow. Push tubular solenoid activated control valves effectively reverse and direct the air flow of the blower in a desired flow circuit to selectively inflate or deflate desired bladders of the patient torso support and rotating system. The blower is driven by an adjustable 1,000 to 12,500 rpm motor externally controlled via electronic blower controllers, which may be located within the body of the blower to save space. This 1 stage 12/24 VDC motor adapted with a 5 inch blower produces a pressure from 0 to 12 inches of water, and an air flow from 0 to 32 cfm. The blower and motor are sound insulated and covered to minimize noise.

The electric motor and solenoid valves are controlled by a control panel, which may be preprogrammed or manually operated. An electric motor is utilized to minimize combustion emissions and noise for patient comfort.

Preferably the Minijammer™ motor and blower are mounted on a wheeled cart with a handle, which can be readily positioned near the patient torso support and rotating system. The handle includes a hanging bracket, which is used to hang the cart on the end of a bed footboard. The blower has reversible valve controlled nozzles connected in an air circuit in communication with the patient torso support rotating system bladders to simultaneously inflate one pair of bladders while deflating another pair of bladders.

The patient torso support and rotating system may include a layer of a plurality of fluid filled inflatable and deflatable latitudinal, longitudinal, or checkerboard top cells attached to the base sheet underneath the bladders. These top cells are connected in a circuit such that every other top cell inflates and deflates in unison to oscillate the support points of the patient lying on a mattress. In one preferred embodiment mattress patient turning system includes a plurality of inflatable latitudinal base cells attached to the base sheet beneath the inflatable and deflatable cells to support the patient's bony protuberances at all times during the oscillation sequence.

Preferably, the mattress patient turning system is constructed of a flexible, washable material such as rubberized nylon, which can be cleaned on a regular basis. A removable washable woolen or cotton sheet may be included, if desired, for added patient comfort, and to prevent soiling of the mattress. If a fleece sheet is incorporated, the added padding also minimizes bedsores.

Manual controls to regulate the inflation sequences are employed with patients supervised by a caregiver to insure that the health care provider regularly visits the patient to provide treatment. However, for home use, the patient torso support and rotating system may include programmable logic controls associated with the inflation means to selectively inflate or deflate the bladders and cells in a desired sequence, such as in an undulating wave pattern. Vibration means may also be included and associated with the fluids filling the top cells to vibrate the top cells. In another embodiment, the mattress patient turning system also includes a heater associated with the fluids filling the top cells to heat the fluid.

To prevent heel bed sores and patient sliding, when the head of the bed is elevated, an inflatable latitudinal heel support bladder may be attached to the base sheet in a position below and normal to the midline of the bed sheet underneath the butterfly bladders below the buttocks of the patient such that when the heel support bladder is inflated, it elevates the legs and heels of a patient. It thus prevents sheer forces by preventing the patient from sliding, when the head of the bed is elevated, by securing the patient's buttocks in position. This heel support may be removably attached to the base sheet via ties or fasteners to accommodate longer bodies patients, or for elevating the legs by different elevation points.

The patient torso support and rotating system is thus operated in a manner for the butterfly bladder stacks to rotate a patient up to 90 degrees on their hip, or to alter periodically the angle of repose for support therapy. The oscillating support bladders act to minimize bedsores and aid in circulation. Use of pre-programmable controls minimizes the requirements for periodic manual adjustments of the patient, and insures that patients are repeatedly supported in various positions.

In a preferred embodiment, the base sheet has a top and bottom sized approximately 80 inches in length and 35 inches in width to fit under the entire patient. The base sheet may include a pocket the length and width of the base sheet into which a cushioning bladder, such as a foam under mattress, may be inserted to prevent dead spots where a patient contacts the mattress between the inflatable bladders.

Attached to the centerline of the top of the base sheet are two opposed pairs of inflatable butterfly bladder pillows, leaving an approximately 14-inch top headspace. The bottom bladder pillow is approximately 34 inches in length and 14.5 inches in width and is connected to an air source. A top bladder pillow is in communication with the bottom bladder pillow chamber and is approximately 36 inches in length and 16.5 inches in width. It is also attached by its inner edge to the centerline of the base sheet and by its undermiddle to the center of the bottom bladder pillow. Thus stacked under the patient's torso, the patient is first gently raised and tilted by partially inflating the top and bottom pillows up to 30 degrees for rotation therapy. Both the top and bottom bladder pillows are fully inflated when it is desired to tilt the patient 90 degrees on his side.

This preferred embodiment has a 17.5 inch by 35 inch foot pillow running along the bottom of the base sheet which may be separately inflated and deflated to vary the elevation of a patient's heels and feet. It also may have its base sheet covered with a layer of a plurality of inflatable and deflatable latitudinal top cells. These top cells are connected in a circuit such that every other top cell inflates and deflates in unison. Attached to the bottom of the base sheet underneath the top cells may be a plurality of fixed inflated latitudinal base cells which continually support the patient, regardless of the state of inflation of the top cells.

Inflation means, such as an air pump, fluid pump, a combination electric motor and blower described above, etc., are associated with the inflatable and deflatable top and base cells in a circuit to selectively inflate and deflate them to oscillate the mattress support points of the bed confined patient.

By aligning the base cells beneath the top cells, the base sheet holds the cells in a manner that regardless of the state of inflation of the top cells, the base cells prevent bony protuberances of a patient from collapsing the cells to contact the support surface.

In another preferred embodiment, the top cells are filled with liquid, and vibration means are associated with the liquid filled top cells to vibrate the top cells to massage the patient and promote blood circulation. Thus by vibrating the filling liquid, and selectively inflating and deflating the top cells in an oscillation pattern (preferably an undulating wave pattern), the patient's support contact with the mattress system is continually varied to minimize or prevent bed sores.

It is also feasible to include a heater associated with the fluids filling the top cells to heat the mattress for patient comfort. The vibrator, heater, and inflation means are preferably controlled by a control panel which may be preprogrammed to control the temperature, oscillation rate, and inflation sequence.

The top cells are semi-circular and approximately 2 inches in diameter. The bottom cells are also semi-circular of corresponding diameter, and generally are located beneath the top cells. The diameter of the cells is sized to prevent patent contact with a support surface.

This patient torso support and rotating system may also be used with any mattress or hammock support system to not only oscillate and vibrate the patient, but to assist in turning the patient. The patient torso support and rotating system thus enables a single attendant to turn a patient without assistance, and further provides for patient comfort, while at the same time preventing or minimizing bed sores for confined patients. Thus, a single care-giver is able to solely position/reposition a patient in a significantly cost effective manner. For immobilized patient's lying on their side, both bladders can be inflated to cradle and act as a pressure relieving to system to minimize bed sores and provide for patient comfort.

DESCRIPTION OF THE ILLUSTRATED EMBODIMENTS

Figure 1:
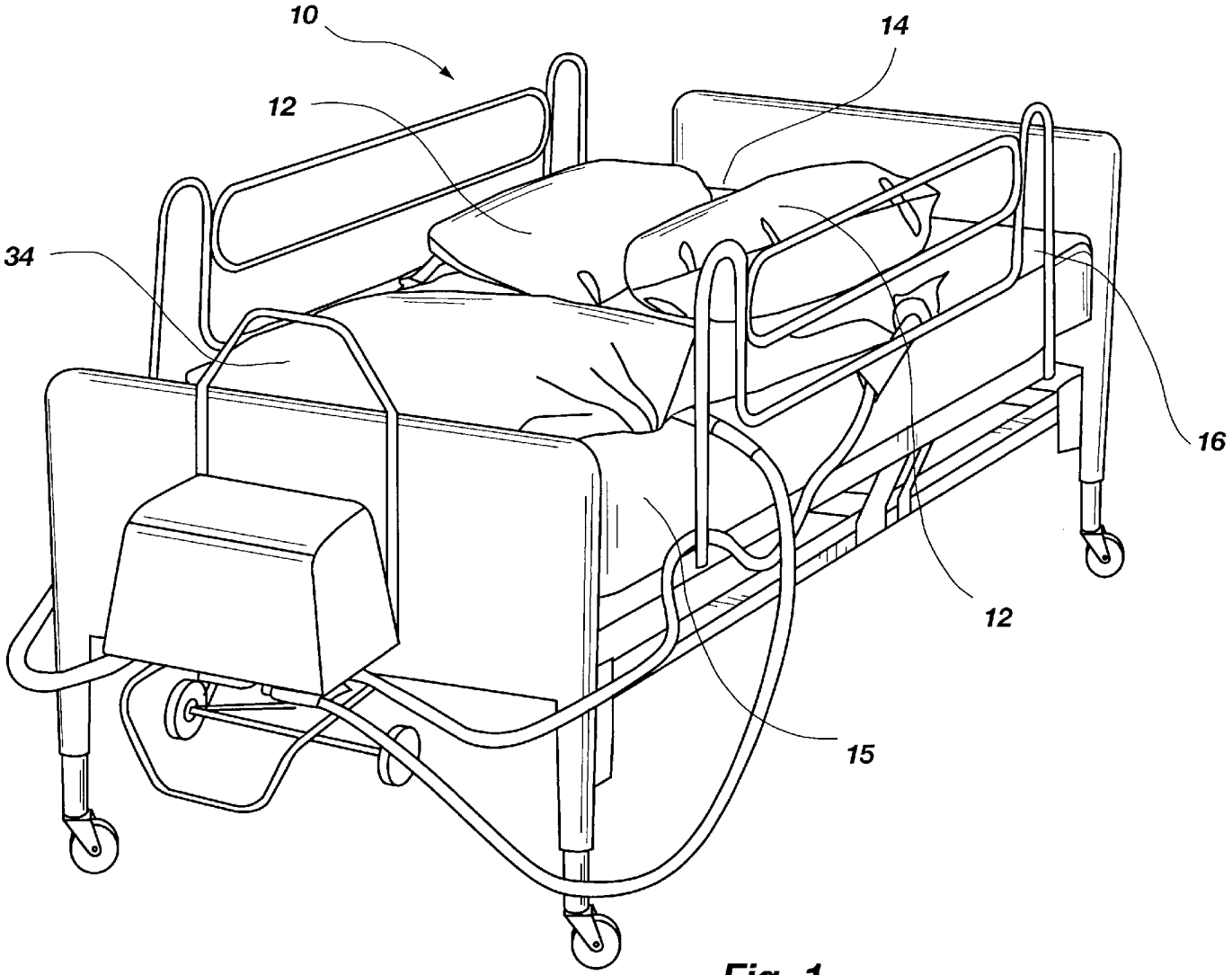
FIG. 1 illustrates a perspective view of one preferred embodiment of the invention.

The patient torso support and rotating system 10 is designed to selectively inflate and deflate a plurality of side by side stacked inflatable and deflatable wing-like butterfly patient turning bladders 12 attached to the centerline (midline) of a base sheet 14. The base sheet 14 is approximately 79 inches by 34 inches and sized to cover the support surface of a mattress and attach thereto via securing means, such as strap loop ends 15, to secure it to the support surface of a mattress. The two side by side stacked wing-like inflatable and deflatable butterfly patient turning bladders 12 are structured to fit under each side of the torso of a patient lying on the midline of the base sheet 14 to rotate the patient up to 90 degrees to turn on their hip, when both butterfly bladders 12 on one side of the patient are inflated.

Figure 1B:
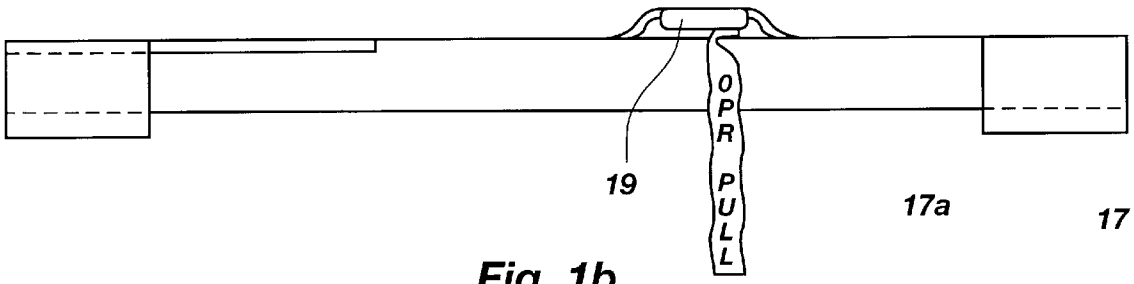
FIG. 1*b* is a side view of the embodiment shown in FIG. 1*a*
Figure 2:
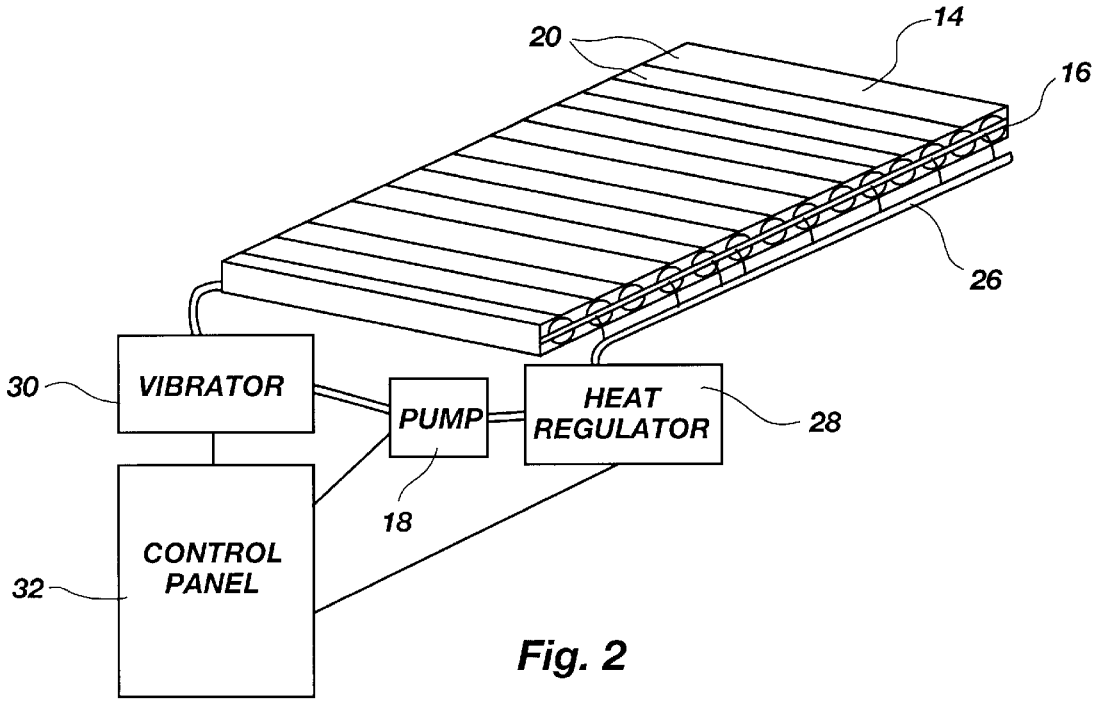
FIG. 2 illustrates a perspective view of oscillating top cells.

Attached underneath the base sheet 14 is an oscillation bladder cell system 16 shown in FIG. 2. In other preferred embodiments shown in FIG. 1*b*, a side pocket 17 runs the length of the base sheet 14, defining an opening into which a 4 inch thick foam under mattress 17*a* is inserted to prevent bottoming out of the patient against the mattress. FIG. 1*b* also shows a CPR emergency pull attached to a rapid emptying valve 19 to deflate the bladders 12 in the event of a CPR emergency.

The inflation means, shown as a high flow low pressure pump 18 with a blower venturi described below to simultaneously inflate one pair of bladders 12 while deflating another pair of bladders 12 to selectively simultaneously inflate and deflate them with fluid. As shown in FIG. 1*c*, the maximum recommended angle of rotation is approximately 30 degrees for rotation therapy.

Preferably, the pump 18 fully inflates the bladders within 30 seconds or less, and has an operating sound level in the 50 decibel range to minimize patient disturbance. In the preferred embodiment, the stacked butterfly bladders 12 on one side of the patient are inflated the same amount as those on the other side of the patient are deflated to insure that the patient is secured therebetween and more rapidly turned. Thus the patient can be safely and rapidly turned to change sheets, pads, etc.

The oscillation bladder cell system 16 variably adjusts the points of support of a bedridden patient to prevent bed-sores. Covering the oscillation bladder cell 16 is the patient torso support and rotating system 10 comprised of a bed sheet 14 shown in FIG. 1 to which are attached a plurality of inflatable interconnected parallel latitudinally aligned bladders 20. These bladders 20 are then slowly inflated and deflated in a given sequence to vary the points of support of a reclining patient. The inflatable latitudinal bladders 20 are bisected and held in position by the base sheet 14 to form top inflatable and deflatable semi-circular cross-section tubular cells. Located underneath them are bottom inflated semi-circular cross-section interconnected tubular cells 24. The base sheet 14 thus aligns the semi-circular cross-sectional tubular cells 22, and 24 to insure that a patient will not contact a support surface as the bladders 12 are selectively inflated and deflated.

Figure 2A:
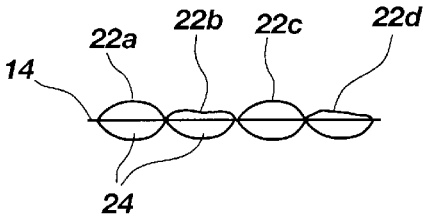
FIG. 2*a* is cross sectional view of the oscillating top cells shown in FIG. 2.
Figure 2B:
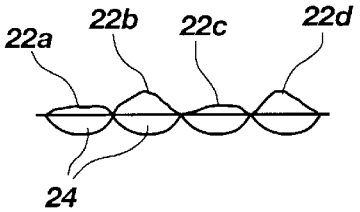
FIG. 2*b* illustrates another cross sectional view of the oscillating top cells shown in FIG. 2.

The inflatable bladders 20 are interconnected with a series of tubes 26 which are connected to a heat regulator 28, a pump 18, a vibrator 30 controlled by a control panel 32. The control panel 32 selectively inflates one bladder top cell 22*a* and deflates its juxtaposed neighbor top cell 22*b* such that every other juxtaposed bladder top cell 22 is periodically alternatively raised and lowered to oscillate up and down to vary the points of support of the bedridden patient as shown in cross sections FIG. 2*a* and FIG. 2*b*.

The control panel 32 is programmable to oscillate the top cells 22, and can raise of lower the temperature of the fluids within the bladders 20 to provide for patient comfort. Also, the vibrator 30 may be activated to vibrate the bladders 20 to gently massage the patient.

Although parallel bladders 20 are shown to selectively oscillate the mattress patient turning system 10, other configurations may be used to gradually change the support points of a patient. It is also contemplated that the mattress patient turning system 10 will be covered by a removable fitted sheet (not shown) to provide for patient comfort and cleanliness.

Figure 3A:
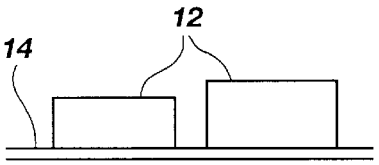
FIGS. 3*a, b, c* are a cross sectional view of another embodiment of a plurality of bladders shown in FIG. 1.
Figure 3B:
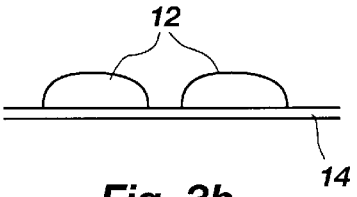
Figure 3C:
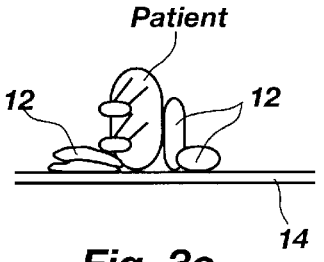

The configuration of the patient turning bladders 12 may vary. FIG. 3 shows patient turning bladders configured as two side by side pairs of wing-like bladders 12 stacked upon one another and selectively inflated.

Figure 1C:
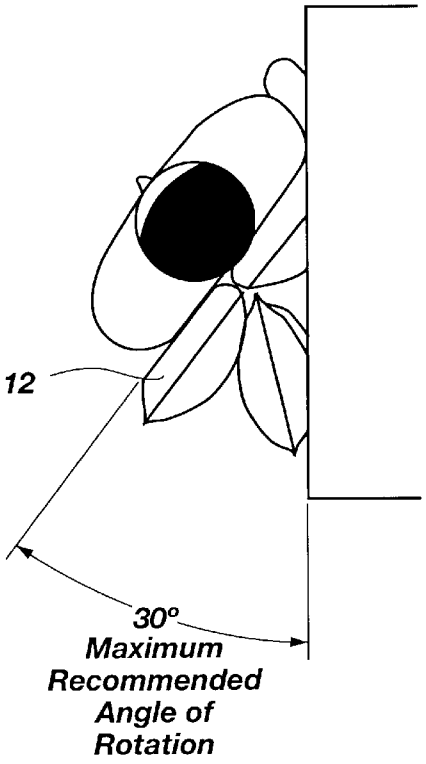
FIG. 1*c* is another side view of the embodiment shown in FIG. 1*a*.
Figure 1A:
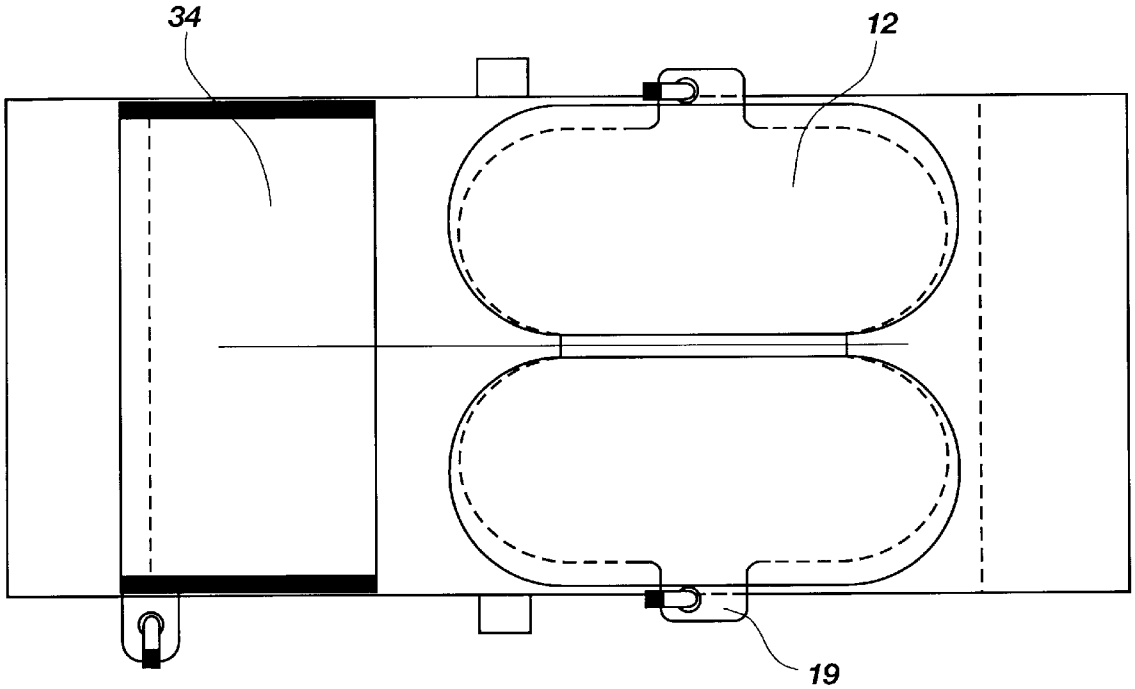
FIG. 1*a* is a top view of the embodiment shown in FIG. 1

A parallel heel support leg lift bladder 34 shown in FIG. 1 is adjustably attached to the base sheet 14 and inflated to elevate a patient's heels to prevent bed sores. Thus positioned below the buttocks, it prevents a patients from sliding when the end of the bed is raised.

Figure 4:
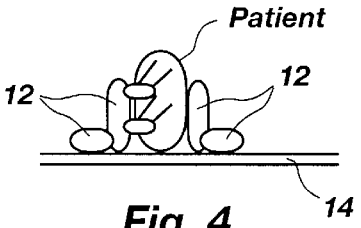
FIG. 4 is another cross sectional view of the embodiment shown in FIG. 3.

FIG. 4 is another cross sectional view of the embodiment shown in FIG. 3 illustrating how the both butterfly bladders 12 on both sides of the patient are inflated to cradle and secure the patient in position and alleviate some of the weight on the hip. To change the angle of repose, the butterfly bladders 12 on one side of the patient are simultaneously inflated and the butterfly bladders 12 on the other side of the patient are simultaneously deflated, or vice versa. This inflation system allows infinite adjustment of the patient's angle of repose. It also enables the patient to be held in position via the bladders 12. Further, when cradled, the inflating butterfly bladders 12 themselves act as a pressure relieving system to take some of the weight off the patient's hip.

Figure 5:
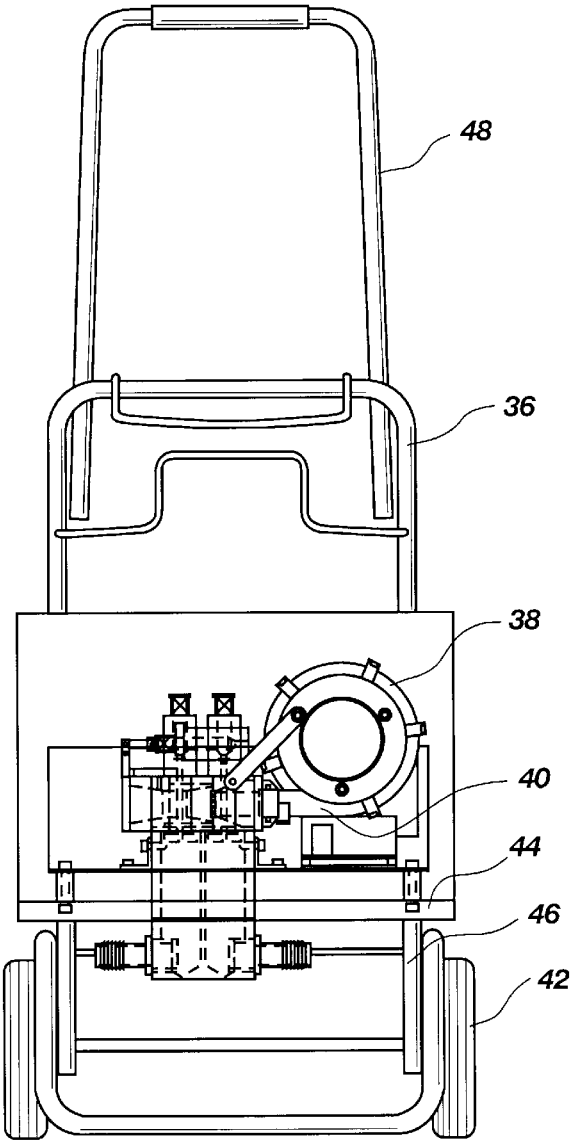
FIG. 5 is a front view of a preferred cart mounted motor and blower.
Figure 6:
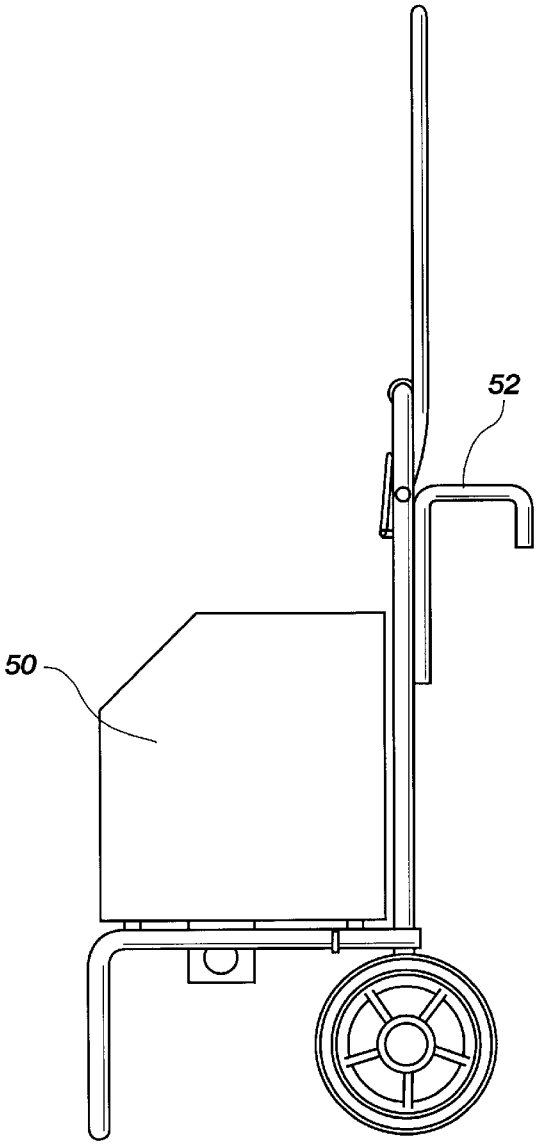
FIG. 6 is a side view of the cart-mounted motor and blower shown in FIG. 5.

FIG. 5 is a front view of a preferred wheeled cart 36 with a mounted electric motor 38 and blower 40. The cart 36 has wheels 42 with a mounting platform 44 attached to a frame 46. An extended handle 48 is attached to the frame 46 for ease in moving the powered blower 40. The blower 40 and electric motor 38 are enclosed in a sound reducing cover 50 shown in FIG. 6. Attached to the frame 46 is a hanging bracket 52 to hang the cart 36 from the footboard of a bed.

Figure 7:
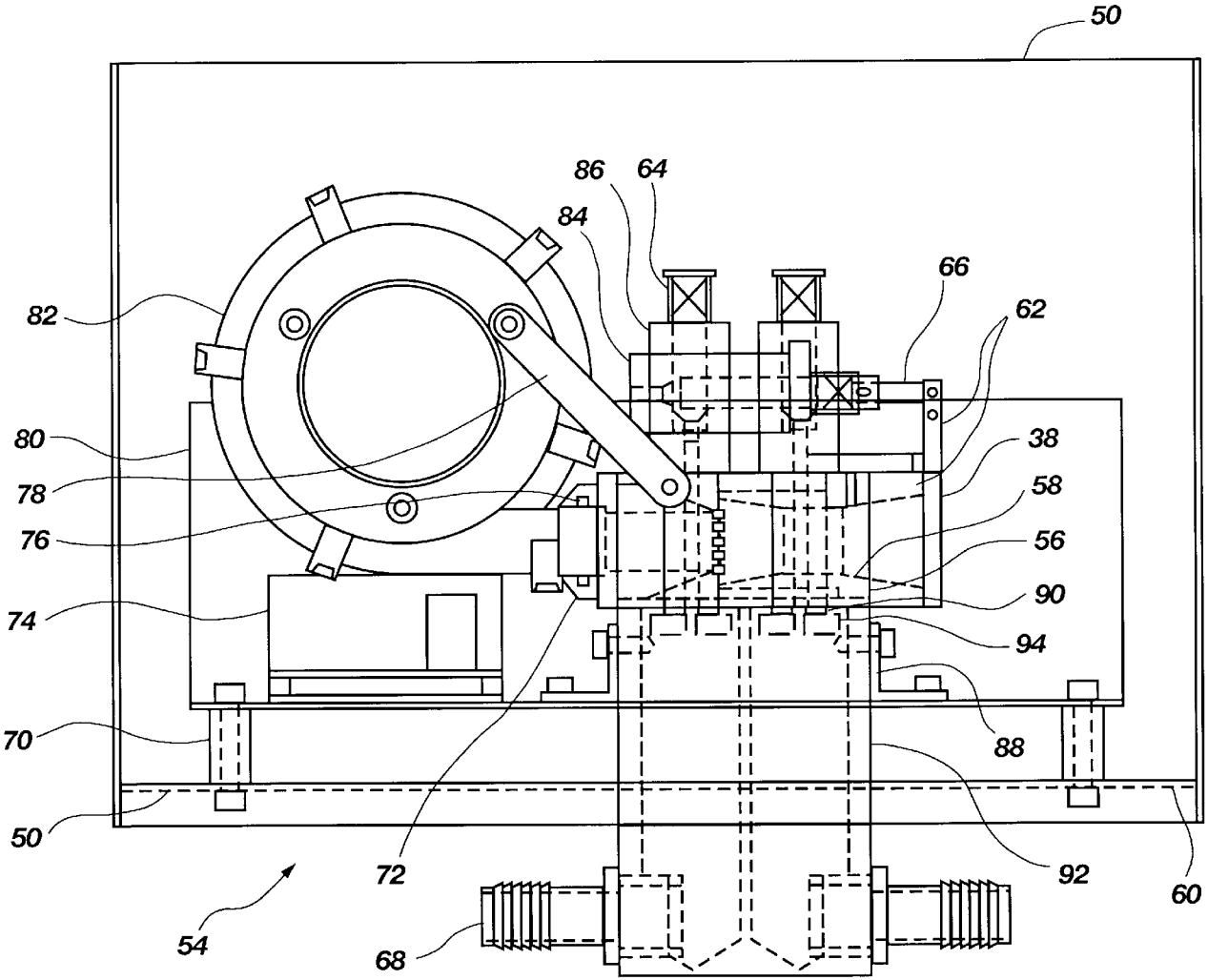
FIG. 7 is a front view of the motor and blower assembly shown in FIG. 5.

FIG. 7 shows the motor 38 and blower assembly 54 within the cover 50. The motor 38 is secured with a mounting bracket 56 and upper pan 58 and lower pan 60. The preferred blower 40 generates high flow, low pressure (approximately 2 psig) via a venturi system controlled by a series of solenoid actuators 62 including a spring 64 activated valve exhaust link 66. This venturi system has a venturi nozzle 68 associated with the lower valve body 70 which virtually sucks the air from certain bladders 12 at the same rate it fills others. A mounting bracket 72 secures the lower valve body 70 to the upper pan 58. A seal plate 74 is associated with the exhaust paddle 76 of the upper valve body 78 and fitting 80. A silicone O-ring 82 is associated with a solenoid bracket 84 of the exhaust paddle bracket 86. This assembly thus directs the blower 40 input outlet 88 sealed with an O-ring 90 through the valve body 70 assembly. To minimize vibration, a shock absorbing spacer 92 separates the upper pan 58 and lower pan 60.

The drawings illustrate a preferred blower 40—the Minijammer™ one stage brushless DC blower produced by Ametek Technical Motor Division, 627 Lake Street, Ken Ohio. This 12 or 24 volt DC brushless blower 40 utilizes push tubular solenoid activated control valves 70 which effectively reverse and direct the air flow of the blower in a desired flow circuit to selectively inflate or deflate desired bladders 12 of the patient torso support and rotating system 10.

Figure 9:
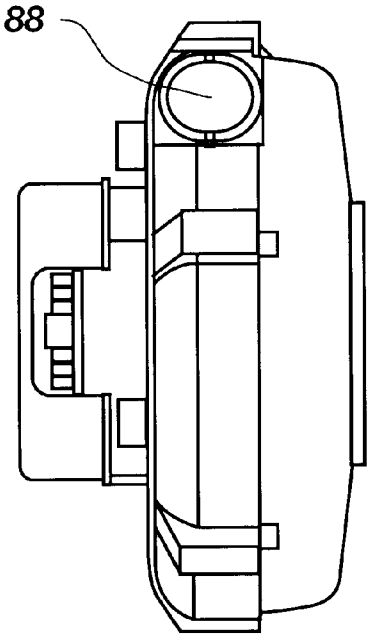
FIG. 9 is a side view of the blower shown in FIG. 8.
Figure 8:
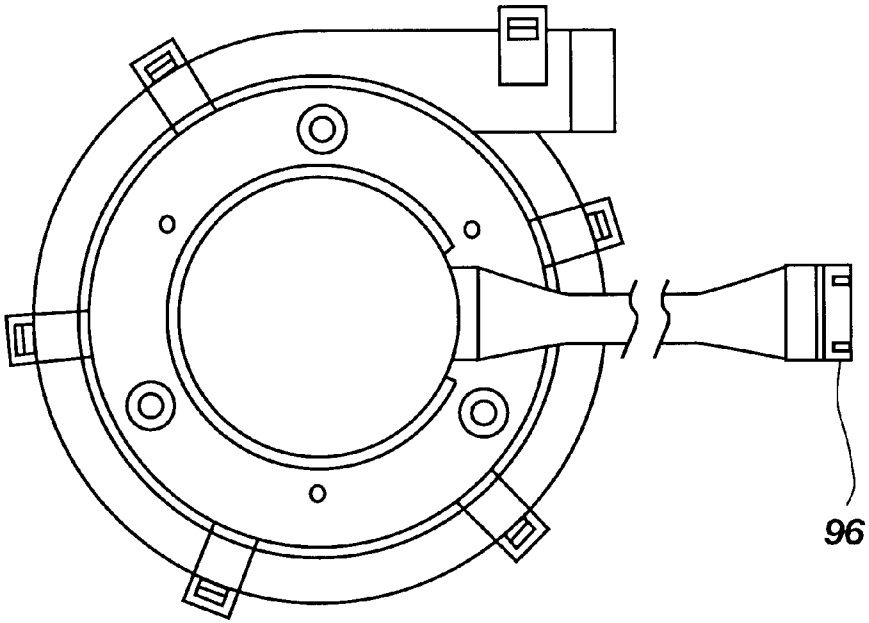
FIG. 8 is a front view of the blower.
Figure 10:
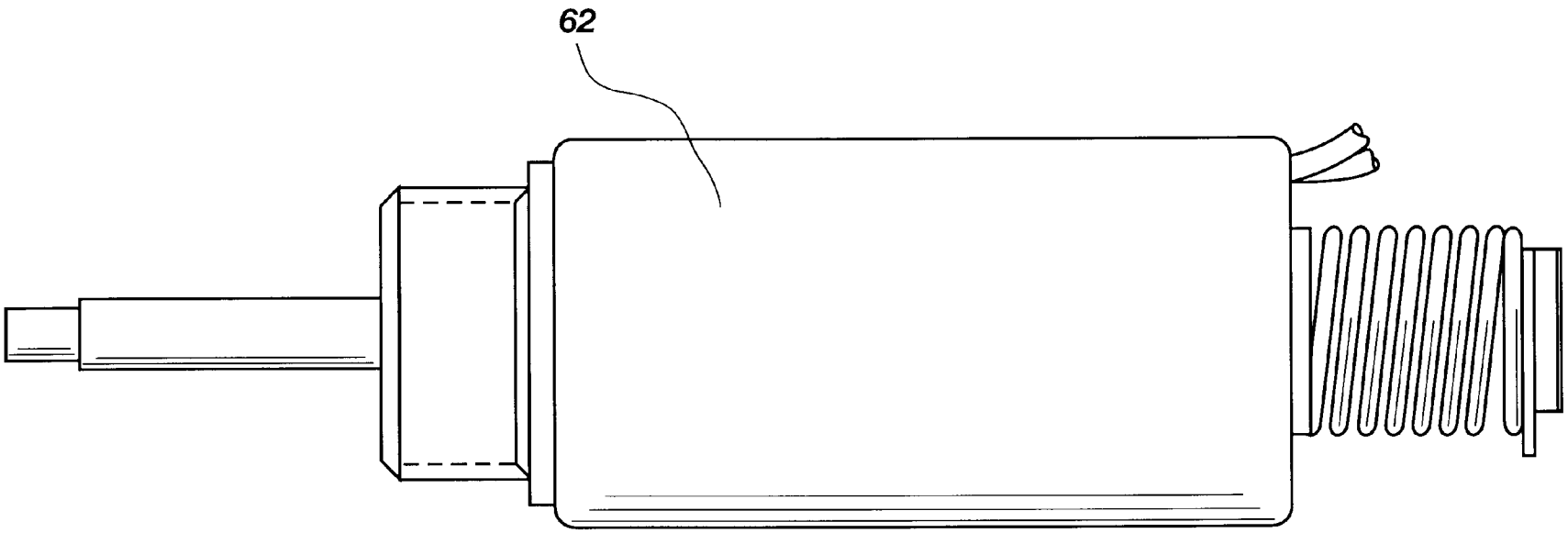
FIG. 10 is a side view of a solenoid shown energized.

FIG. 8 is a front view of the blower 40 with optional cordsets 96 attached. FIG. 9 is a side view of the blower shown in FIG. 8 showing the blower 40 input outlet 88. FIG. 10 is a side view of a solenoid actuator 62 shown energized.

Although this specification has referred to the illustrated embodiments, it is not intended to restrict the scope of the appended claims. The claims themselves recite those features deemed essential to the invention.

I claim:

1. A patient torso support and rotating system comprising:

a. a base sheet sized to fit under a patient with means to secure to a support surface of a mattress, b. two side by side sets of stacked variable and infinitely adjustable inflatable and deflatable butterfly bladders attached by their respective inner edges proximate the longitudinal centerline of the base sheet and sized of a width and each positioned to fit under one side of the torso of a patient lying thereon, and of a length not extending beyond the patient's buttocks, when inflated, to preclude twisting of a patient's spine and allow the mattress to elevate and bend without interference, and structured, when one butterfly bladder set is fully inflated, to rotate the patient up to 90 degrees to turn on their hip in a first mode, and when the both stacked opposing butterfly bladder sets are inflated to secure the patient therebetween at a desired angle to support and act as a patient support and pressure relieving system in a second mode, c. an inflatable latitudinal heel support bladder is attached to the sheet in a position beginning below the patient's buttocks and extending beneath the legs to elevate the heels of a patient, when inflated, and prevent the patient from sliding if the mattress is elevated to elevate the patient's head and upper torso, and d. inflation means associated with the inflatable and deflatable stacked butterfly and heel support bladders to selectively inflate and deflate them with fluid.

2. A patient torso support and rotating system according to claim 1, including a pocket attached underneath the base sheet defining an opening into which a cushion may be inserted to prevent the patient from bottoming out against the mattress.

3. A patient torso support and rotating system according to claim 1, wherein the inflation means comprise a combination electric motor and blower which fully inflates or deflates the bladders in less than approximately 30 seconds and has a noise level in the 50 decibel range.

4. A patient torso support and rotating system according to claim 3, wherein the electric motor and blower comprises a venturi pump in communication with the bladders to simultaneously inflate one stack of bladders while emptying the opposing stack of bladders.

5. A patient torso support and rotating system according to claim 1, wherein the bladders are constructed of nylon covered polyurethane material.

6. A patient torso support and rotating system according to claim 1, including a plurality of inflatable and debatable latitudinal top cells attached to the base sheet underneath the bladders and connected in a circuit such that every other top cell inflates and deflates in unison to oscillate the support points of the patient.

7. A patient torso support and rotating system according to claim 6, including a plurality of inflatable latitudinal base cells attached to the base sheet beneath the inflatable and deflatable latitudinal top cells to support the patient.

8. A patient torso support and rotating system according to claim 6, including programmable logic controls associated with the inflation means to selectively inflate or deflate the bladders and cells in a desired sequence.

9. A patient torso support and rotating system according to claim 6, including vibration means associated with the fluids filling the top cells to vibrate the top cells.

10. A patient torso support and rotating system according to claim 6, including a heater associated with the fluids filling the top cells to heat the fluid.

11. A patient torso support and rotating system according to claim 6, wherein the top cells are oscillated in an undulating wave pattern.

12. A patient torso support and rotating system according to claim 1, wherein the inflatable latitudinal heel support bladder is movably attached to the sheet to accommodate longer bodied patients.

13. A patient torso support and rotating system comprising:

a. a base sheet with top and bottom sized to fit under a patient with means to secure to the support surface of a mattress, b. two side by side pairs of variable and infinitely adjustable inflatable and deflatable butterfly bladders attached by their respective inner edges proximate the longitudinal middle of the base sheet and sized of a width and each positioned to fit under one side of the torso of a patient lying thereon, and of a length, when inflated, not extending beyond a patients buttocks to preclude twisting of a patient's spine and allow the mattress to elevate and bend without interference, and structured, when one bladder pair is inflated to rotate the patient up to 90 degrees to turn on their hip in a first mode, and when two bladders pairs are inflated to secure the patient therebetween the butterfly bladders at a desired angle to support and act as a pressure relieving system in a second mode, c. an inflatable latitudinal heel support bladder attached to the sheet in a position to elevate the heels of a patient, when inflated, and d. inflation means associated with the inflatable and deflatable bladders to selectively inflate and deflate the bladders.

14. A patient torso support and rotating system according to claim 13, including:

a layer of inflatable and deflatable latitudinal cells covering the base sheet, oscillation means associated with the inflatable and deflatable latitudinal cells to oscillate the mattress support points of the patient, and programmable logic controls associated with the inflation and oscillation means to selectively inflate, deflate, and oscillate the bladders and cells in a desired sequence.

15. A patient torso support and rotating system according to claim 13, wherein the base sheet is washable.

16. A patient torso support and rotating system according to claim 13, including means associated with the inflation means to immediately deflate all bladders.

* * * * *